US008120258B2

(12) United States Patent
Kumakura et al.

(10) Patent No.: US 8,120,258 B2
(45) Date of Patent: Feb. 21, 2012

(54) MAGNETRON

(75) Inventors: Ayako Kumakura, Tochigi (JP); Nagisa Kuwahara, Tochigi (JP); Etsuo Saitou, Tochigi (JP)

(73) Assignee: Panasonic Corporation, Osaka (JP)

( * ) Notice: Subject to any disclaimer, the term of this patent is extended or adjusted under 35 U.S.C. 154(b) by 313 days.

(21) Appl. No.: 12/388,822

(22) Filed: Feb. 19, 2009

(65) Prior Publication Data

US 2009/0218949 A1 Sep. 3, 2009

(30) Foreign Application Priority Data

Feb. 28, 2008 (JP) ..... P2008-047975
Mar. 31, 2008 (JP) ..... P2008-091247

(51) Int. Cl.
*H01J 25/50* (2006.01)

(52) U.S. Cl. ..... 315/39.51

(58) Field of Classification Search ..... 315/39.51, 315/39.53, 39.57, 39.59, 39.63, 39.65, 39.69, 315/39.71

See application file for complete search history.

(56) References Cited

U.S. PATENT DOCUMENTS 4,338,545 A 7/1982 Koinuma et al.
4,395,657 A 7/1983 Tada et al.
4,426,601 A * 1/1984 Tsuzurahara ..... 315/39.51
4,855,645 A * 8/1989 Kinuno et al. ..... 315/39.71
6,670,762 B2 * 12/2003 Aiga et al. ..... 315/39.75
7,375,470 B2 * 5/2008 Baek et al. ..... 315/39.51

FOREIGN PATENT DOCUMENTS

EP 0 263 491 A2 4/1988
JP 53-111272 9/1978
JP 06-267443 9/1994
JP 2002-163993 6/2002

OTHER PUBLICATIONS

Extended European Search Report issued in European Patent Application No. EP 09152226.8 dated Mar. 15, 2010.

* cited by examiner

*Primary Examiner* — Douglas W Owens
*Assistant Examiner* — Minh D A
(74) *Attorney, Agent, or Firm* — McDermott Will & Emery LLP

(57) ABSTRACT

The present invention provides a magnetron which can conduct more magnetic flux in the active space at the periphery of a cathode structure to thereby further improve the efficiency of a magnetic circuit. The magnetron of the present invention includes an anode cylinder on which inner wall a plurality of anode vanes are provided, a pole piece provided on an end side of the anode cylinder, a circular magnet provided on the vicinity of the pole piece, and a magnet ring provided between the anode cylinder and the circular magnet. An outer diameter of the magnet ring is smaller than or equal to the outer diameter of the circular magnet and larger than or equal to the outer diameter of the anode cylinder. The magnet ring has a portion on a surface of the pole piece side whose normal line is non-parallel to the central axis of the anode cylinder.

15 Claims, 14 Drawing Sheets

MAGNETRON

BACKGROUND OF THE INVENTION

The present invention relates to a magnetron used for a device utilizing a microwave such as a microwave oven.

The aforesaid magnetron is configured in a manner, as an example, that a magnet ring (also called as a conversion plate or a shim plate) formed by magnetic material is disposed between an anode cylinder having anode vanes disposed radially on the inner wall surface thereof and an circular magnet disposed on the opening end side of the anode cylinder, in order to improve a magnetic force in an active space at the periphery of a cathode structure (refer JP-A-2002-163993, for example). Since the magnet ring is disposed, much magnetic flux can be conducted into the active space, so that the efficiency of a magnetic circuit can be improved.

In order to improve the efficiency of the magnetic circuit, it is important to conduct much magnetic flux in the active space at the periphery of the cathode structure. However, since the magnet ring of the magnetron of the related art has a uniform thickness, the magnetic flux is also attracted on the outer periphery side which does not so much contribute to the conduction of the magnetic flux in the active space at the periphery of the cathode structure, so that there is a limit in the improvement of the efficiency of the magnetic circuit.

Further, since the magnet ring of the magnetron of the related art has an annular uniform shape, the magnet ring can not be restricted and so free in the radial direction. Thus, the positioning of the magnet ring is difficult in the manufacturing process of the magnetron. As a result, the magnet ring likely deviates at its center axis from the radial direction of the circular magnet and the anode cylinder. When the center axis of the magnet ring deviates, the magnetic characteristics in the active space at the periphery of the cathode structure can not be realized so as to coincide with the design. Thus, there arises a problem that the oscillation becomes unstable and desired oscillation efficiency can not be achieved. In order to solve this problem the magnetron disclosed in JP-A-2002-163993 is configured in a manner that, as shown in a perspective view of FIG. 14 and a partial sectional diagram of FIG. 15, a cut and erected part 100*a* is provided at the outer circumferential part of a magnet ring 100, and then the cut and erected part 100*a* is fit into the outer circumferential part on the cathode structure side of an circular magnet 110 to thereby position the cut and erected part to thereby prevent the positional deviation in the radial direction of the magnet ring 100 and the circular magnet 110. The JP-A-2002-163993 also discloses another example having a cut and erected part provided at the inner circumferential part and a still another example having an arbitrary number of projection portions provided on the entire surface on the side contacting to the circular magnet.

However, the magnetron disclosed in the JP-A-2002-163993 provides the cut and erected part at the outer circumferential part or the inner circumferential part of the magnet ring or provides the arbitrary number of projection portions on the entire surface in order to suppress the positional deviation of the circular magnet and the magnet ring. There arises a problem that the cut and erected part or the projection portions obstructs the flow of the magnetic flux lines to thereby degrade the efficiency of the magnetic circuit.

SUMMARY OF THE INVENTION

The invention is made in view of the aforesaid circumstances and an object of the invention is to provide a magnetron which can conduct more magnetic flux in the active space at the periphery of a cathode structure to thereby further improve the efficiency of a magnetic circuit.

The magnetron according to the invention includes an anode cylinder on which inner wall a plurality of anode vanes are provided, a pole piece provided on an end side of the anode cylinder, a circular magnet provided on the vicinity of the pole piece, and a magnet ring provided between the anode cylinder and the circular magnet. The outer diameter of the magnet ring is smaller than or equal to the outer diameter of the circular magnet, and larger than or equal to the outer diameter of the anode cylinder. The magnet ring has a portion on a surface of the pole piece side whose normal line is non-parallel to the central axis of the anode cylinder.

The first aspect of the invention is that a first thickness of the magnetic ring at a first position which is distant from the center of the magnetic ring in the outer diameter of the anode cylinder and a second thickness of the magnetic ring at a second position which is distant from the center of the magnetic ring in the outer diameter of the circular magnet are different.

According to this configuration, the thickness of the magnet ring from the position corresponding to the outer diameter position of the anode cylinder to the position corresponding to the outer diameter position of the circular magnet differs from the thickness of the remaining part of the magnet ring. Thus, unlike the related art, there is no fear that the cut and erected part or the projection portions obstructs the flow of the magnetic flux lines, and so the more magnetic flux can be flown in the active space at the periphery of the cathode structure, whereby the efficiency of the magnetic circuit can be improved. Further, unlike the related art, the invention does not employ the structure that the seal flange of a large diameter is coupled to the opening portion of the anode cylinder and the magnet ring is joined to the seal flange, but the invention employs the structure that the anode cylinder is disposed separately from the magnet ring, whereby the assembling procedure can be performed easily.

Examples of the thickness differences in the magnet ring are as follows.

The first example is that a thickness of a part of the magnet ring between the first position and the second position is smaller than a thickness of the remaining part of the magnet ring.

The second example is that the thickness of the part of the magnet ring between the first position and the second position is partially thin The third example is that the thickness of the magnetic ring is linearly changes from the first position to the second position.

In addition, the magnet ring is configured in a manner that the magnetic ring includes a plurality of bended parts directed to the anode cylinder and a plurality of plane parts at the outer periphery of the magnetic ring. The bended parts and the plane parts are periodically and alternately arranged. Thus, both the increase of a flowing amount of the magnetic flux in the active space at the periphery of the cathode structure and the positioning of the anode cylinder and the magnet ring can be achieved simultaneously. That is, the improvement of the efficiency of the magnetic circuit and the stabilization of the magnetic field distribution in the active space can be achieved simultaneously.

The second aspect of the invention is that the magnet ring has a projection portion directing to the anode cylinder. The projection portion is provided between a first position which is distant from the center of the magnetic ring in the outer diameter of the anode cylinder and a second position which is distant from the center of the magnetic ring in the outer diameter of the circular magnet.

According to this configuration, the projection portion is provided between the first and the second position. Thus, unlike the related art, there is no fear that the cut and erected part or the projection portions provided at the outer circumferential end of the magnet ring obstructs the flow of the magnetic flux lines. As a result, since more magnetic flux can be flown in the active space at the periphery of the cathode structure, the efficiency of the magnetic circuit can be improved.

Examples of the shape of the projection portion are as follows.

The first example is that the projection portion is formed in a rail shape so as to continue along a circumferential direction of the magnet ring.

The second example is that at least one projection portion is formed in a convex shape, such as mountain shape.

The third example is that a plurality of the projection portions is disposed along the circumferential direction of the magnet ring.

The forth example is that the projection portion is formed at a position contacting with an outer side surface of the anode cylinder.

The performance can be further improved when the magnetron is applied to a device utilizing a microwave such as a microwave oven.

According to the magnetron of the invention, the improvement of the efficiency of the magnetic circuit and the stabilization of the magnetic field distribution in the active space can be achieved.

DETAIL DESCRIPTION OF PREFERRED EMBODIMENTS

Hereinafter, a preferred embodiment of the invention will be explained in detail with reference to drawings.

Figure 1:
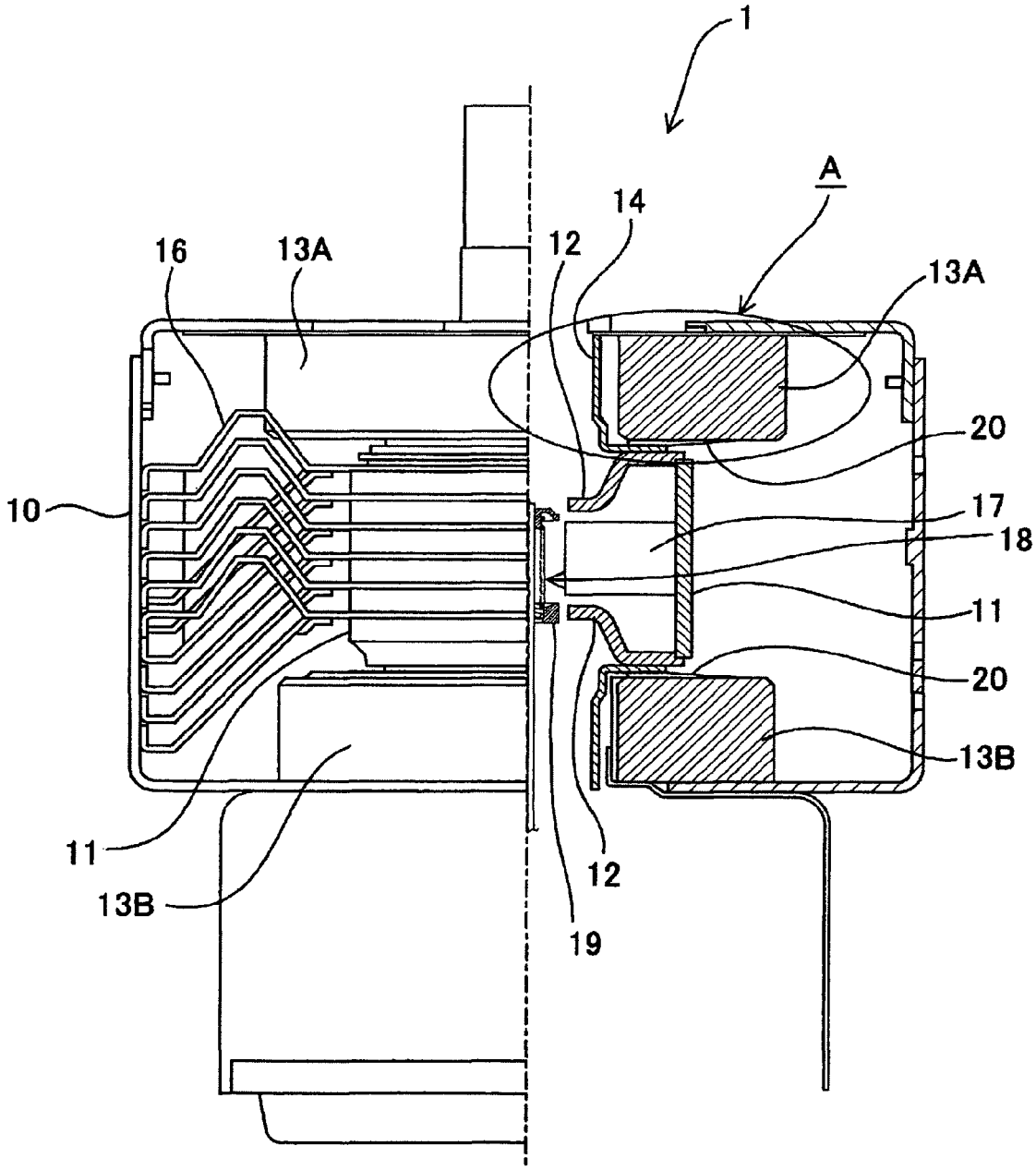
FIG. 1 A partially cutaway view of a magnetron according to an embodiment of the invention and also a diagram showing an anode cylinder, circular magnets, cooling fins etc. within a magnetic yoke.
Figure 2:
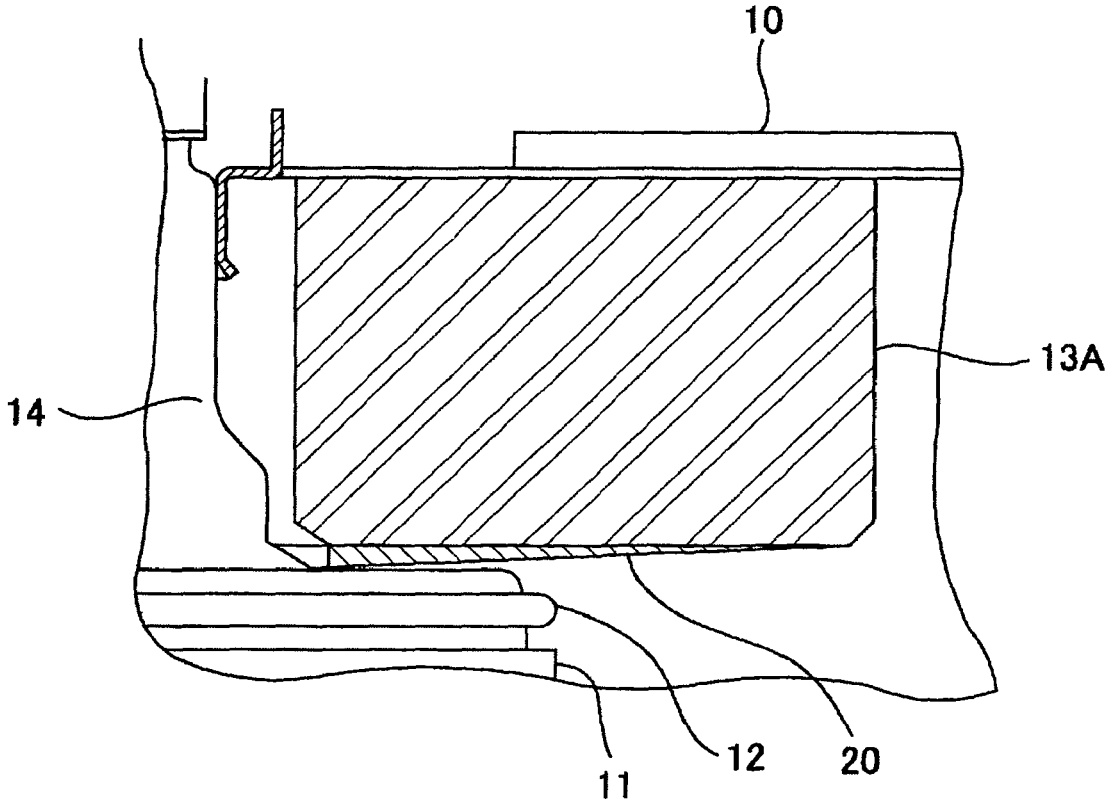
FIG. 2 An enlarged diagram of a portion A of the magnetron shown in FIG. 1.

FIG. 1 is a partially cutaway view of the magnetron according to the embodiment of the invention and shows an anode cylinder, circular magnets, cooling fins and so on within a magnetic yoke. FIG. 2 is an enlarged diagram of the portion A of the magnetron 1 shown in FIG. 1. In FIGS. 1 and 2, within the magnetic yoke 10, there are disposed the anode cylinder 11 having pole pieces 12 respectively fixed at opening ends on the both sides thereof, the doughnut-shaped circular magnets 13A, 13B respectively disposed just above the upper part and just below the lower part of the anode cylinder 11, and a side tube 14 on the anode side. Further, magnet rings 20 are disposed between a part of the upper portion of the side tube 14 and the circular magnet 13A and between a part of the lower portion of the side tube 14 and the circular magnet 13B, respectively.

Cooling fins 16 are fit in the outer circumferential surface of the anode cylinder 11. A plurality of anode vanes 17 are disposed radially on the inner circumferential surface of the anode cylinder 11 (only one of the anode vanes 17 is shown in FIG. 1). A cathode structure 19 is disposed at the center portion of the anode cylinder 11. A space surrounded by the cathode structure 19 and the anode vanes 17 forms an active space 18. The pole piece 12 is formed in a funnel shape by such a processing of subjecting a plate member of magnetic material having a small magnetic resistance value such as iron to a squeezing processing and so on.

Figure 3:
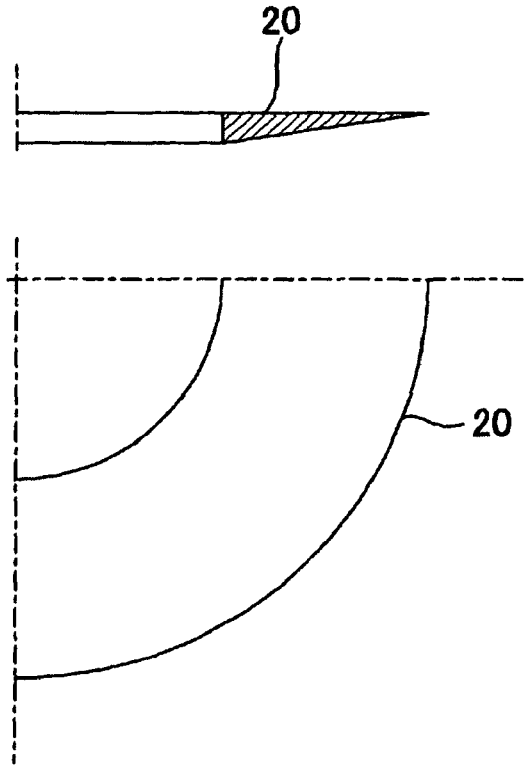
FIG. 3 Diagrams showing a magnet ring of the magnetron shown in FIG. 1.

The magnet ring 20 is configured in a manner that the outer diameter thereof is equal to or smaller than the outer diameter of the circular magnets 13A, 13B and is equal to or larger than the outer diameter of the anode cylinder 11. Further, as shown in FIG. 3, the magnet ring is formed in a tapered shape in a manner that the thickness thereof reduces gradually toward the outer circumferential end thereof from the inner circumferential end thereof. FIG. 3 shows a sectional diagram of a part of the magnet ring 20 and also shows the lower side of this part. Since the magnet ring 20 is not configured to have the entirely uniform thickness but configured to have the thicker thickness on the inner circumferential side and the thinner thickness on the outer circumferential side, most of the magnetic flux generated at the circular magnets 13A, 13B flows toward the inner side. That is, more magnetic flux flows in the active space 18 at the periphery of the cathode structure 19. Since more magnetic flux flows in the active space 18 at the periphery of the cathode structure 19, the efficiency of the magnetic circuit can be improved.

Figure 4:
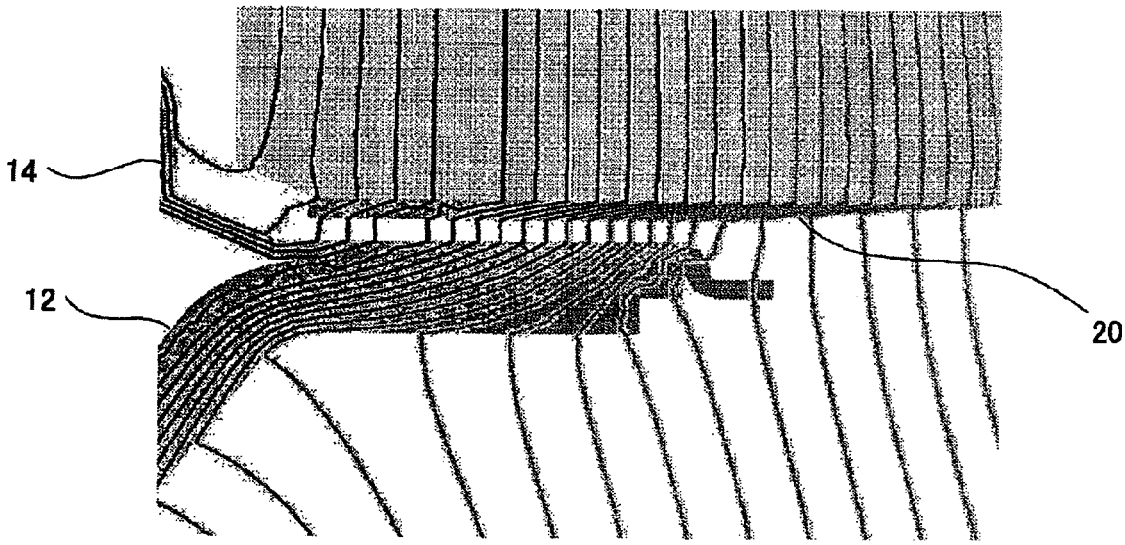
FIG. 4 A typical diagram showing the distribution of the magnetic field in the vicinity of the cathode of the magnetron shown in FIG. 1.
Figure 5:
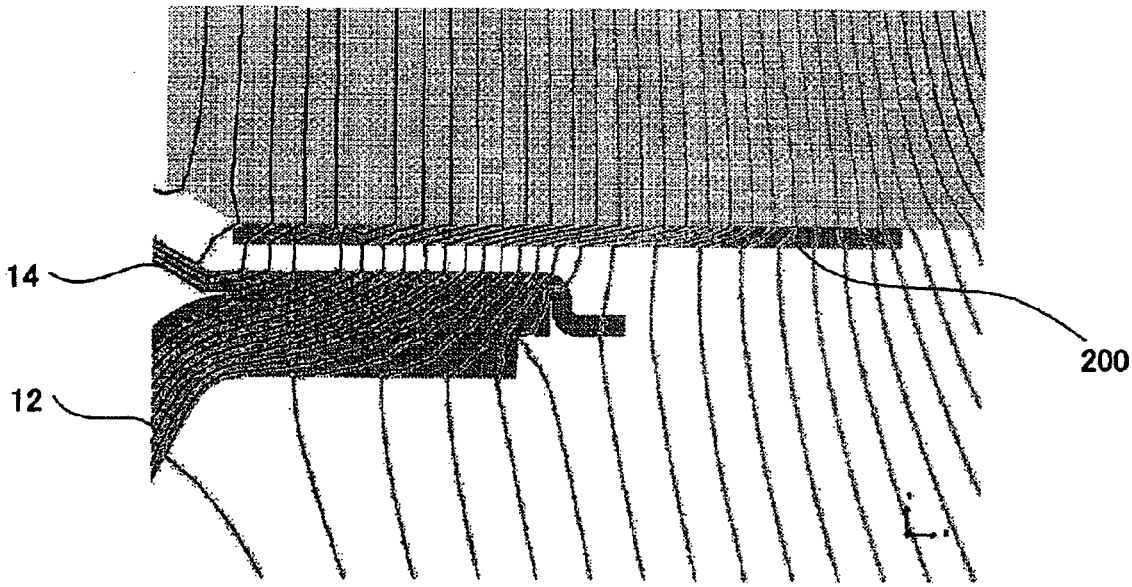
FIG. 5 A typical diagram showing the distribution of the magnetic field in the vicinity of the cathode of the magnetron of the related art.
Figure 6:
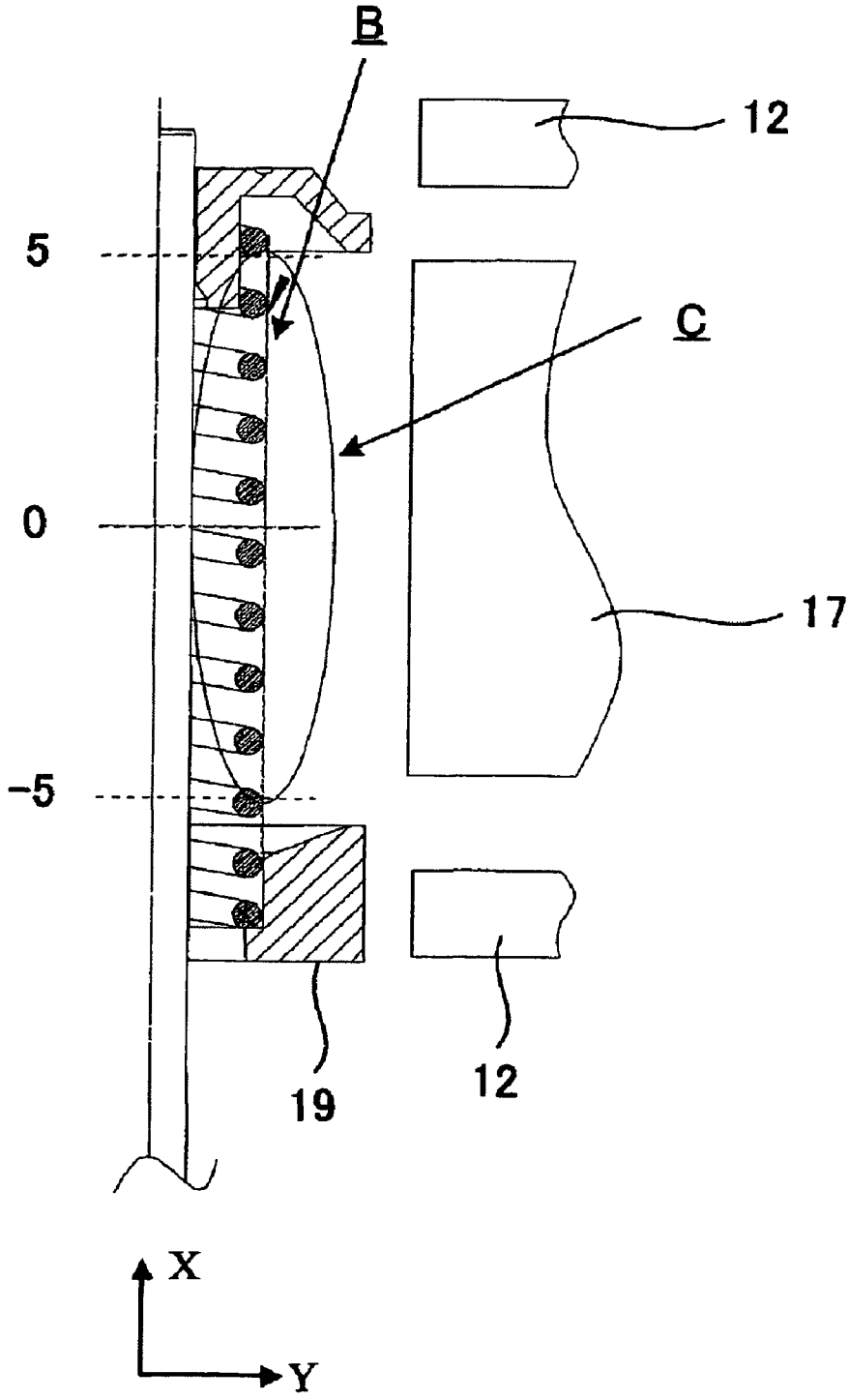
FIG. 6 An enlarged diagram of a magnetic field analyzing portion.
Figure 7:
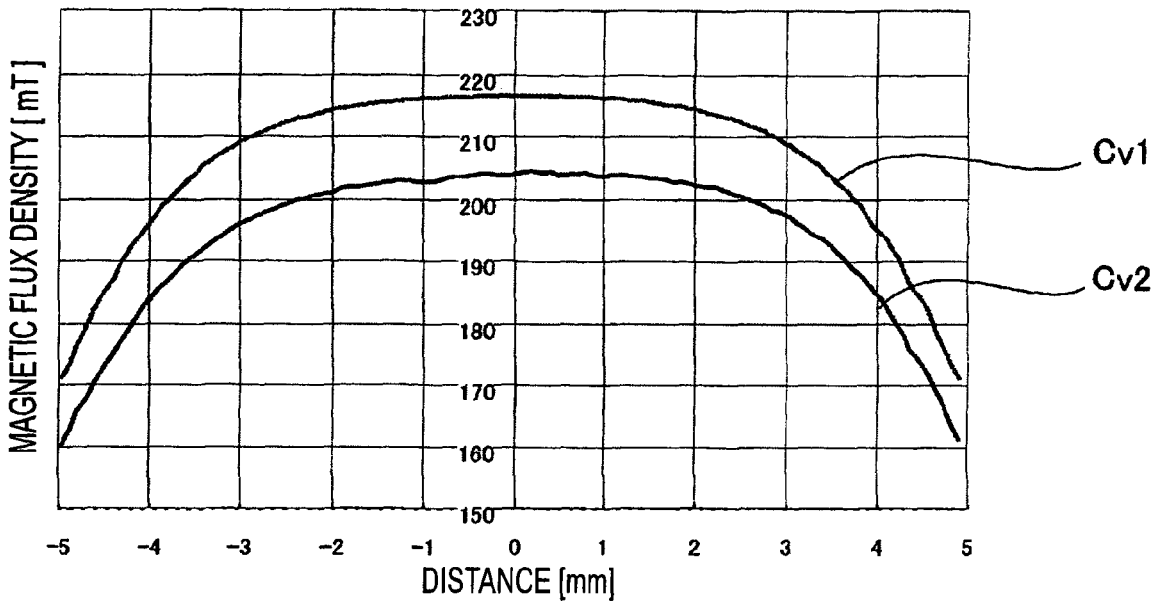
FIG. 7 A graph showing the magnetic flux density at a position near the cathode in a range of X=−5 mm to 5 mm.

FIG. 4 is a typical diagram showing the distribution of the magnetic field in the vicinity of the cathode in the case of using the magnet ring 20, and FIG. 5 is a typical diagram showing the magnetic field distribution in the vicinity of the cathode in the case of using the magnet ring 200 having the uniform thickness of the related art. Further, FIG. 6 is an enlarged diagram of a magnetic field analyzing portion, in which a position shown by an arrow B represents the position near the cathode and a portion shown by an arrow C represents the portion shown by the magnetic field distribution. FIG. 7 is a graph showing the magnetic flux density in the case where the range in the X-axis direction at the position B near the cathode in FIG. 6 is set to be in a range from −5 mm to 5 mm, in which the abscissa represents the distance (mm) and the ordinate represents the magnetic flux density B (mT). In FIG. 7, Cv1 represents the characteristics of the magnetic flux density in the case of using the magnet ring 20 according to the invention and Cv2 represents the characteristics of the magnetic flux density in the case of using the magnet ring 200 of the related art. It will be understood from the figure that the magnetic flux density is higher by about 13 (mT) in the case of using the magnet ring 20 according to the invention.

In this manner, according to the magnetron 1 according to the embodiment, the magnet ring is configured in a manner that the outer diameter thereof is equal to or smaller than the outer diameter of the circular magnets 13A, 13B and is equal to or larger than the outer diameter of the anode cylinder 11 and further the magnet ring is formed in the tapered shape in a manner that the thickness thereof reduces gradually toward the outer circumferential end thereof from the inner circumferential end thereof. Thus, unlike the related art, there is no fear that the cut and erected part or the projection portions obstructs the flow of the magnetic flux lines. As a result, since more magnetic flux can be flown in the active space at the periphery of the cathode structure, the efficiency of the magnetic circuit can be improved. Further, unlike the related art, the embodiment does not employ the structure that the seal flange of a large diameter is coupled to the opening portion of the anode cylinder and the magnet ring is joined to the seal flange, but the embodiment employs the structure that the anode cylinder is disposed separately from the magnet ring, whereby the assembling procedure can be performed easily.

Although the aforesaid embodiment employs the magnet ring 20 formed in the tapered shape in a manner that the thickness thereof reduces gradually toward the outer circumferential end thereof from the inner circumferential end thereof, the shape of the magnet ring is not limited thereto and various kinds of shapes may be applied to the magnet ring. Applied examples of the magnet ring 20 will be explained below.

Figure 8:
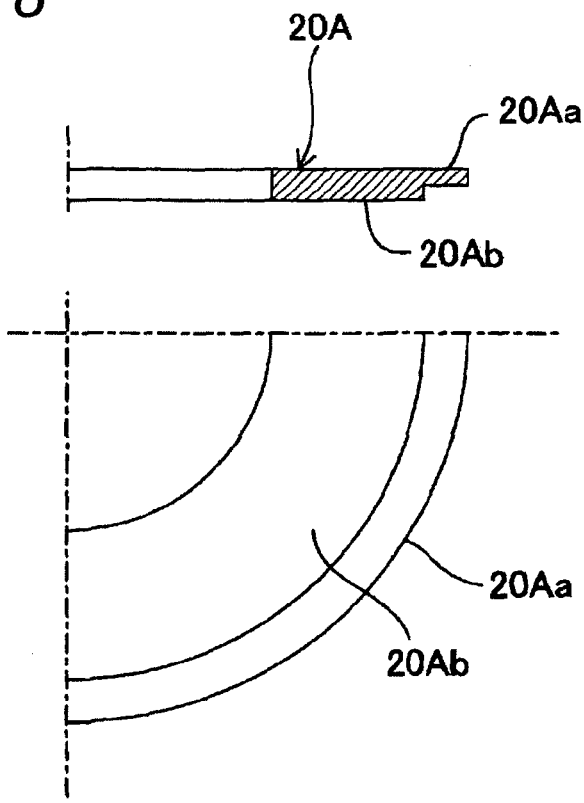
FIG. 8 A diagram showing an applied example of the magnet ring shown in FIG. 3.

A magnet ring 20A shown in FIG. 8 is configured in a manner that the circumferential part 20Aa on the outer circumferential side thereof is made thin and the remaining part 20Ab thereof is made thick. In this case, the circumferential part 20Aa is not made thin gradually but made thin in a step manner.

Figure 9:
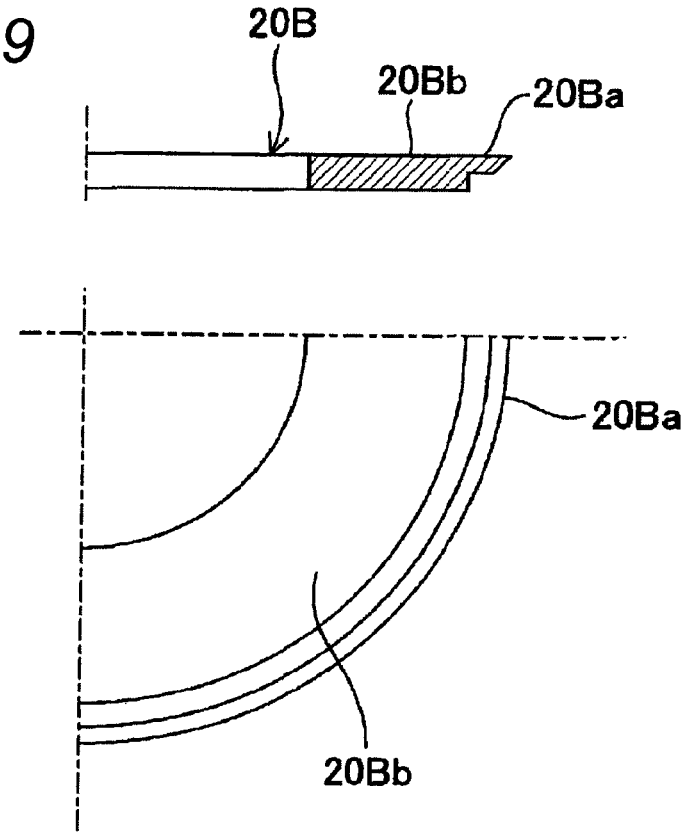
FIG. 9 A diagram showing an applied example of the magnet ring shown in FIG. 3.

A magnet ring 20B shown in FIG. 9 is changed in its thickness in a step manner almost like the magnet ring 20A shown in FIG. 8, but differs therefrom in a point that the tip end of the circumferential part 20Ba on the outer circumferential side thereof is formed in a slanted surface.

Figure 10:
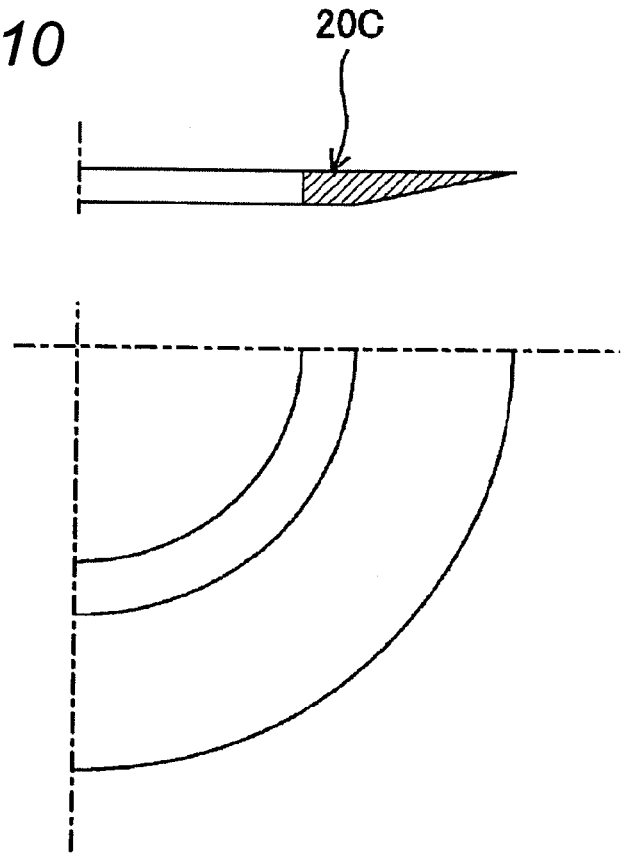
FIG. 10 A diagram showing an applied example of the magnet ring shown in FIG. 3.

A magnet ring 20C shown in FIG. 10 has a tapered shape almost like the magnet ring 20 shown in FIG. 3, but differs therefrom in a point that the taper start point does not locate at the inner circumferential end but at a portion slightly near the center thereof. Further, the taper start point locates between the outer diameter position of the anode cylinder 11 and the outer diameter position of the circular magnet 13A (13B).

Figure 11:
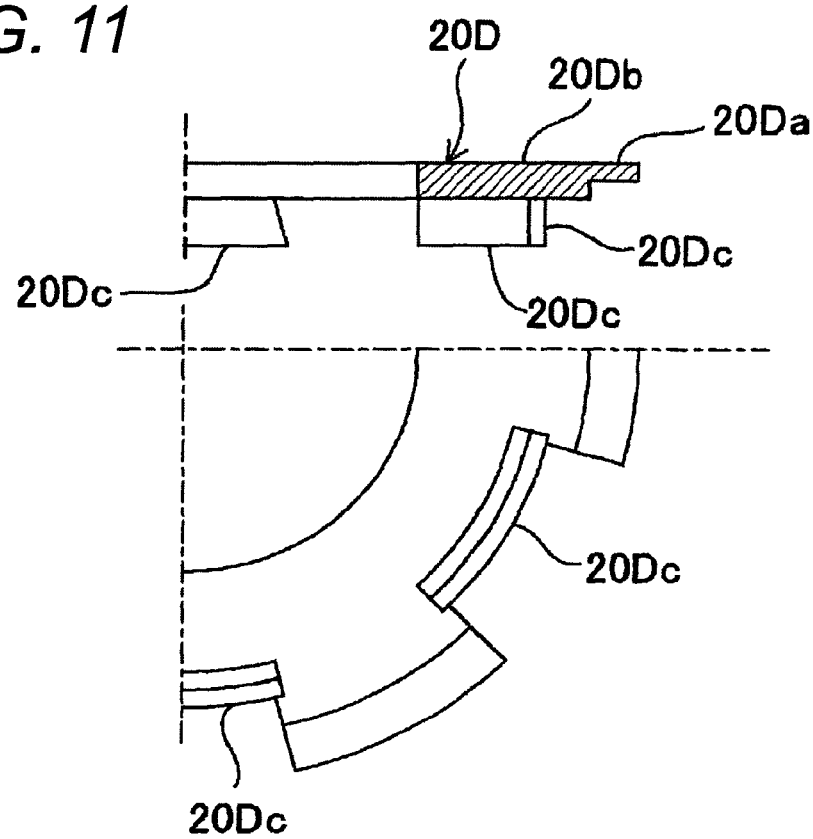
FIG. 11 A diagram showing an applied example of the magnet ring shown in FIG. 3.

A magnet ring 20D shown in FIG. 11 is configured in a manner that the circumferential part 20Da on the outer circumferential side thereof is made thin and the remaining part 20Db thereof is made thick, almost like the magnet ring 20A shown in FIG. 8, but differs therefrom in a point that cut and erected parts 20Dc each bent orthogonally on the anode cylinder 11 side from the outer circumferential end are formed at a constant interval. That is, the magnet ring 20D is configured in a manner that the parts bent from the circumference to the anode cylinder side and the substantially flat parts are alternately and periodically arranged so as to prevent the magnetic leakage from the cut and erected parts 20Dc and stabilize the magnetic field distribution in the active space.

The cut and erected parts 20Dc enables the engagement with the side tube 14 on the anode side, whereby the positional deviation in the radial direction of the magnet ring 20D can be prevented. Since the positional deviation of the magnet ring 20D can be prevented, the magnetic flux becomes stable and so the magnetic field distribution in the active space can be stabilized. Further, since the cut and erected parts 20Dc are provided along the circumferential direction of the magnet ring 20D, the anode cylinder 11 and the magnet ring 20D can be positioned more firmly. Furthermore, since the cut and erected parts 20Dc are not provided at the outer circumferential end of the magnet ring 20D and the parts from 20Db to 20Da are made thinner than the other parts, the flow of the magnetic flux lines are scarcely obstructed and so there does not arise a problem that the efficiency of the magnetic circuit is degraded. Thus, the magnet ring 20D can simultaneously achieve the improvement of the efficiency of the magnetic circuit and the stabilization of the magnetic field distribution in the active space.

Figure 12:
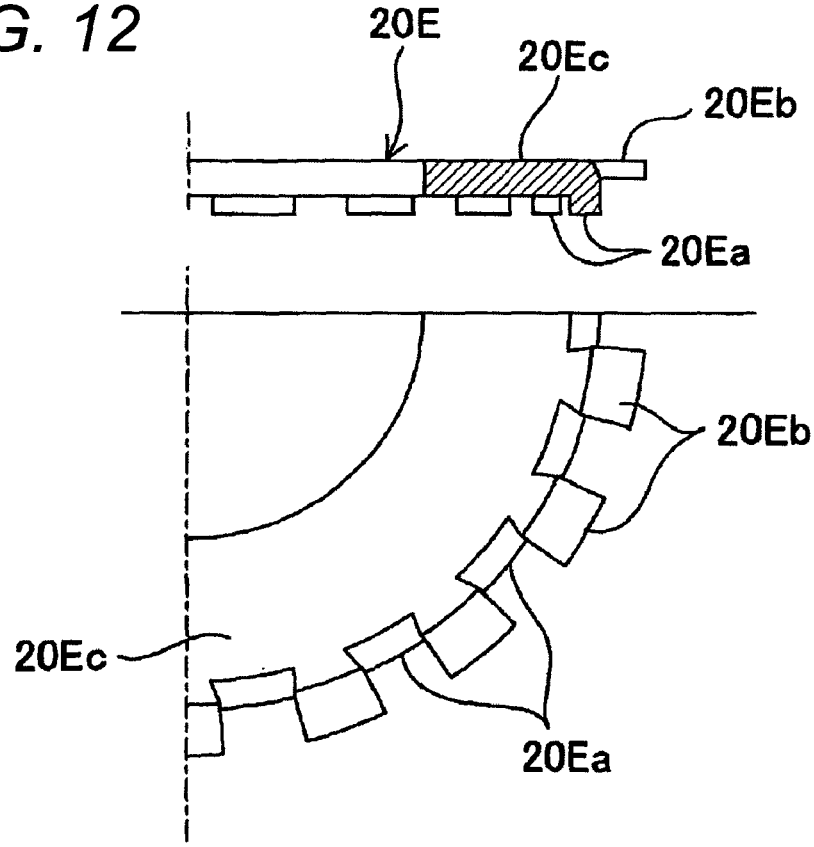
FIG. 12 A diagram showing an applied example of the magnet ring shown in FIG. 3.

A magnet ring 20E shown in FIG. 12 is configured in a manner that bent parts 20Ea bent on the anode cylinder 11 side from the outer circumferential end and flat parts 20Eb are alternately formed in the circumferential direction. The thickness of the flat parts 20Eb is made thinner than that of remaining parts 20Ec. Further, the tip end of the bent part 20Ea locates at the position corresponding to the outer diameter position of the anode cylinder 11.

The bent part 20Ea is narrower in its width and lower in its height as compared with the cut and erected part 20Dc of the magnet ring 20D shown in FIG. 11 but is arranged to enable the engagement with the side tube 14 on the anode side like the cut and erected part 20Dc, whereby the positional deviation in the radial direction of the magnet ring 20E can be prevented. Since the positional deviation of the magnet ring 20E can be prevented, the magnetic flux becomes stable and so the magnetic field distribution in the active space can be stabilized. Further, since the bent parts 20Ea are provided along the circumferential direction of the magnet ring 20E, the anode cylinder 11 and the magnet ring 20E can be positioned more firmly. Furthermore, since the bent parts 20Ea are not provided at the outer circumferential end of the magnet ring 20E, the flow of the magnetic flux lines are scarcely obstructed and so there does not arise a problem that the efficiency of the magnetic circuit is degraded. Thus, the magnet ring 20E can simultaneously achieve the improvement of the efficiency of the magnetic circuit and the stabilization of the magnetic field distribution in the active space.

Figure 13:
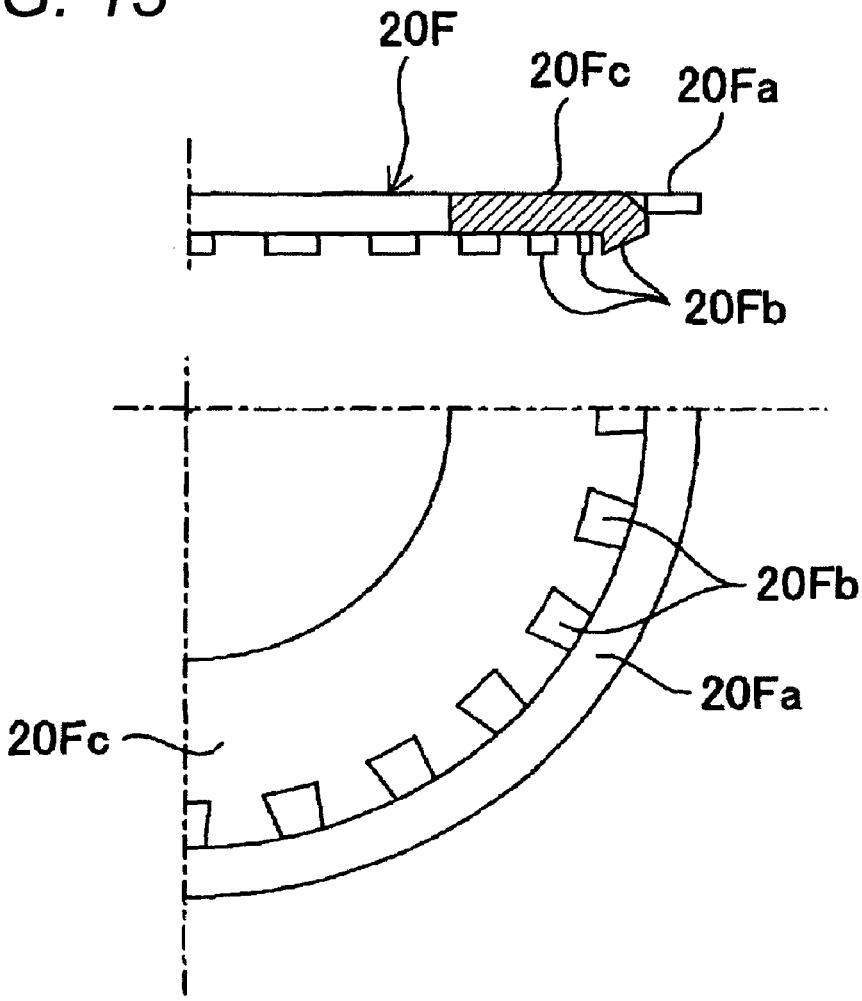
FIG. 13 A diagram showing an applied example of the magnet ring shown in FIG. 3.
Figure 14:
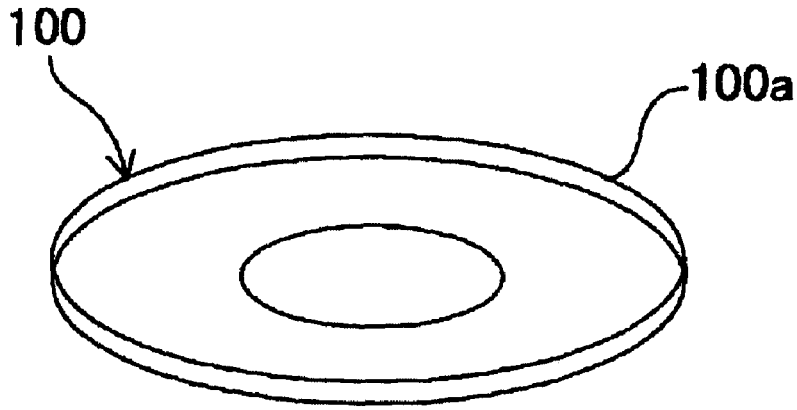
FIG. 14 A perspective view showing a magnetic ring of the related art.
Figure 15:
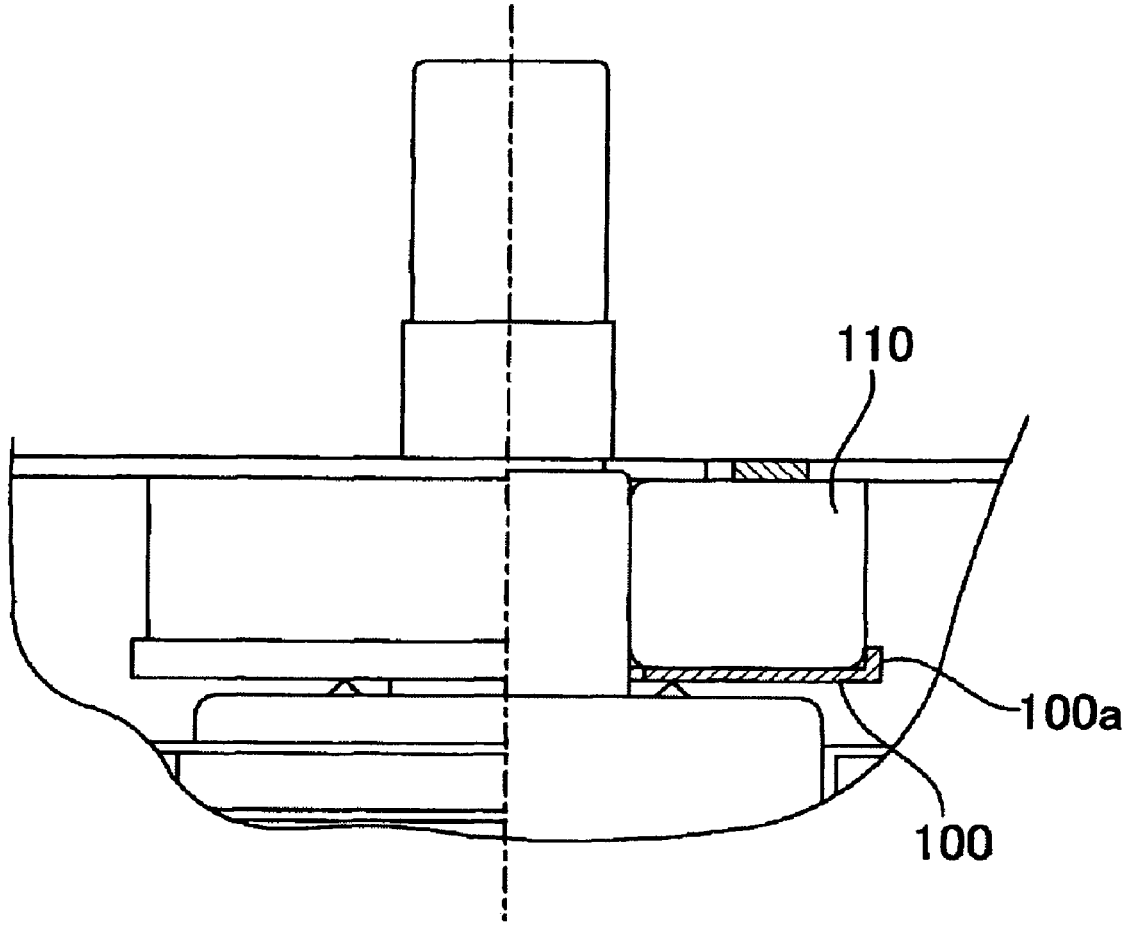
FIG. 15 A partial sectional diagram of a magnetron having the magnet ring shown in FIG. 14.

A magnet ring 20F shown in FIG. 13 is configured in a manner that the circumferential part 20Fa on the outer circumferential side thereof is made thinner than other part 20Fc and projection portions 20Fb are formed at a constant interval in the circumferential direction on the inner circumferential side than the circumferential part 20Fa on the outer circumferential side thereof. The projection portions 20Fb are arranged to enable the engagement with the side tube 14 on the anode side like the bent parts 20Ea of the magnet ring 20E shown in FIG. 12, whereby the magnet ring 20F can be prevented from positionally deviating in the radial direction. Since the positional deviation of the magnet ring 20F can be prevented, the magnetic flux becomes stable and so the magnetic field distribution in the active space can be stabilized.

Further, since the projection portions 20Fb are provided along the circumferential direction of the magnet ring 20F, the anode cylinder 11 and the magnet ring 20F can be positioned more firmly. Furthermore, since the projection portions 20Fb are not provided at the outer circumferential end of the magnet ring 20F, the flow of the magnetic flux lines are scarcely obstructed and so there does not arise a problem that the efficiency of the magnetic circuit is degraded. Thus, the magnet ring 20F can simultaneously achieve the improvement of the efficiency of the magnetic circuit and the stabilization of the magnetic field distribution in the active space.

Another embodiment of the present invention is described as follow.

Figure 16:
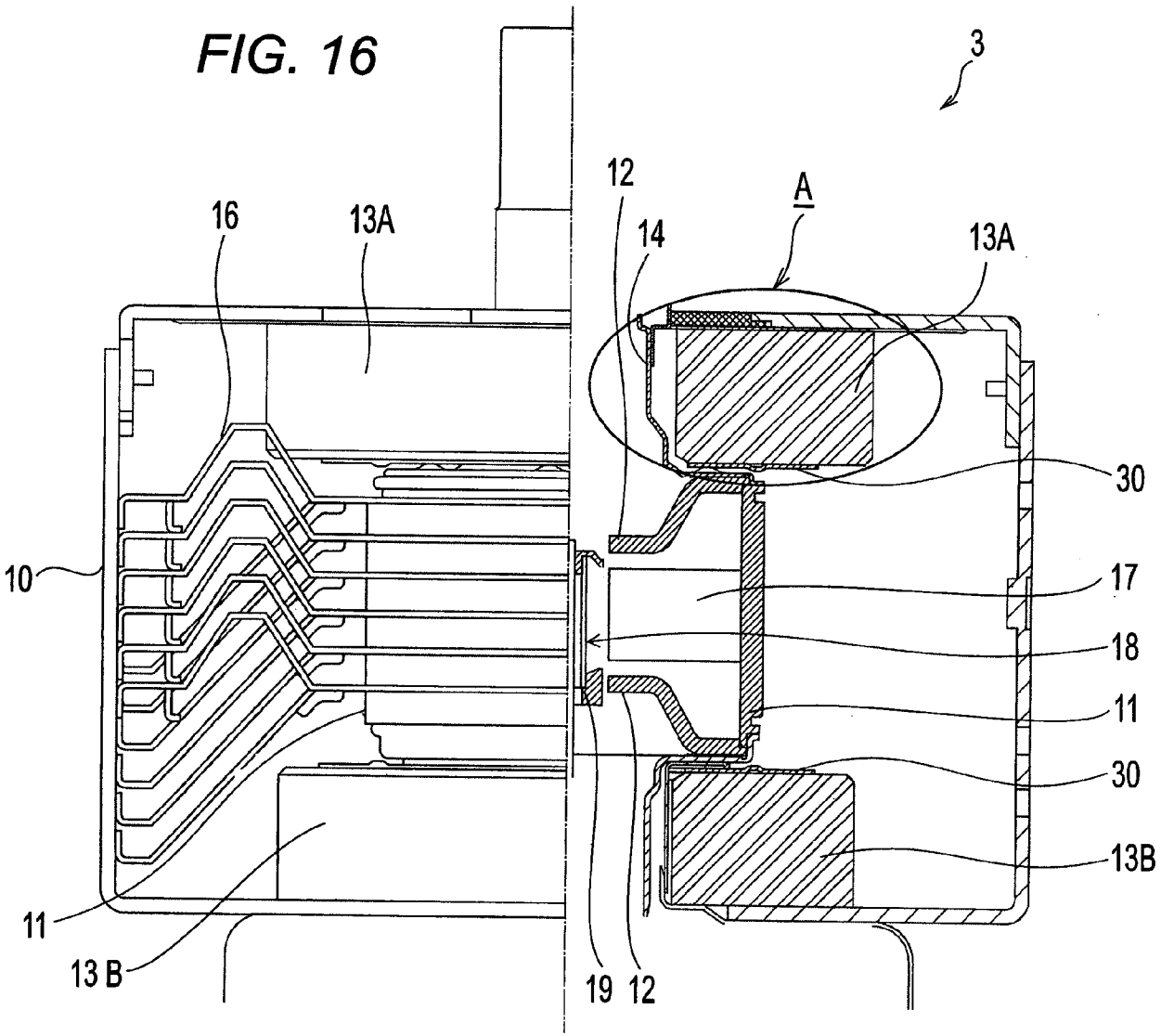
FIG. 16 A partially cutaway view of a magnetron according to an embodiment of the invention and also a diagram showing an anode cylinder, annular magnets, cooling fins etc. within a magnetic yoke.
Figure 17:
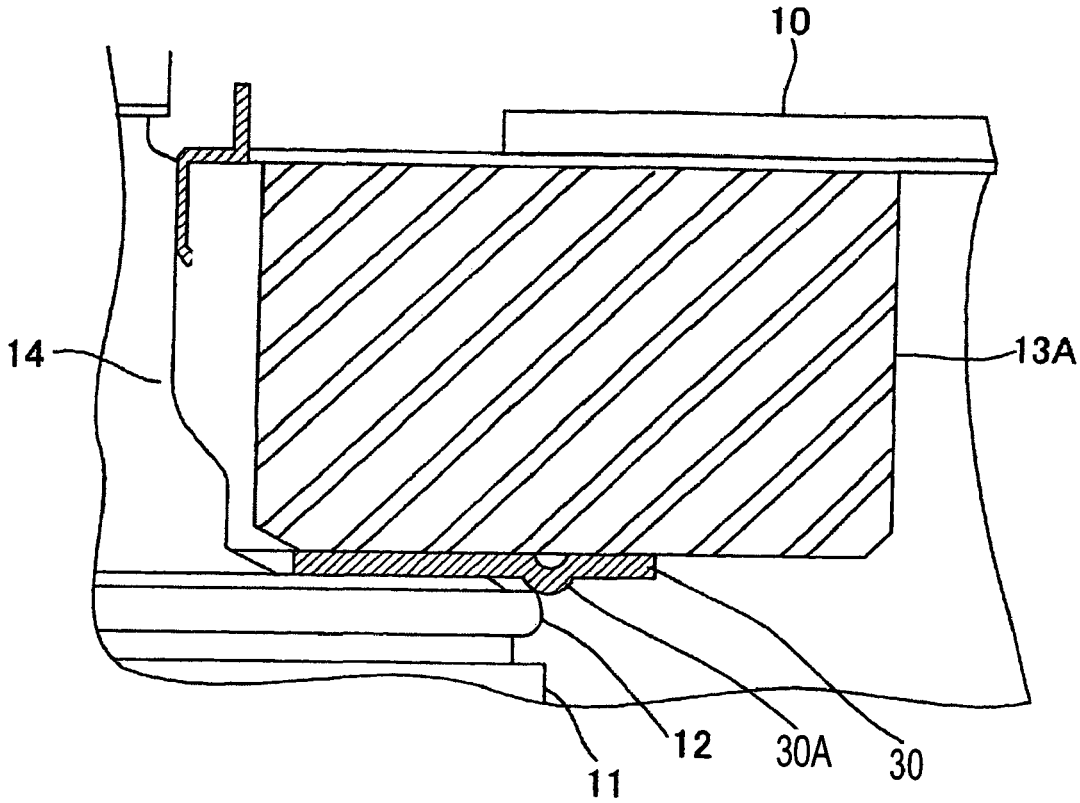
FIG. 17 An enlarged diagram of a portion A of the magnetron shown in FIG. 16.

FIG. 16 is a partially cutaway view of the magnetron according to the embodiment of the invention and shows an anode cylinder, annular magnets, cooling fins etc. within a magnetic yoke. In FIG. 16, same elements of the magnetron 3 as magnetron 1 are assigned same reference numeral in FIG. 1. FIG. 17 is an enlarged diagram of the portion A of the magnetron 3 shown in FIG. 16. In FIGS. 16 and 17, within the magnetic yoke 10, there are disposed the anode cylinder 11 having pole pieces 12 respectively fixed at opening ends on the both sides thereof, the doughnut-shaped annular magnets 13A, 13B respectively disposed just above the upper part and just below the lower part of the anode cylinder 11, and a side tube 14 on the anode side. Further, magnet rings 20 are disposed between a part of the upper portion of the side tube 14 and the annular magnet 13A and between a part of the lower portion of the side tube 14 and the annular magnet 13B, respectively.

Cooling fins 16 are fit in the outer circumferential surface of the anode cylinder 11. A plurality of anode vanes 17 are disposed radially on the inner circumferential surface of the anode cylinder 11 (only one of the anode vanes 17 is shown in FIG. 16). A cathode structure 19 is disposed at the center portion of the anode cylinder 11. A space surrounded by the cathode structure 19 and the anode vanes 17 forms an active space 18. The pole piece 12 is formed in a funnel shape by such a processing of subjecting a plate member of magnetic material having a small magnetic resistance value such as iron to a squeezing processing and so on.

Figure 18:
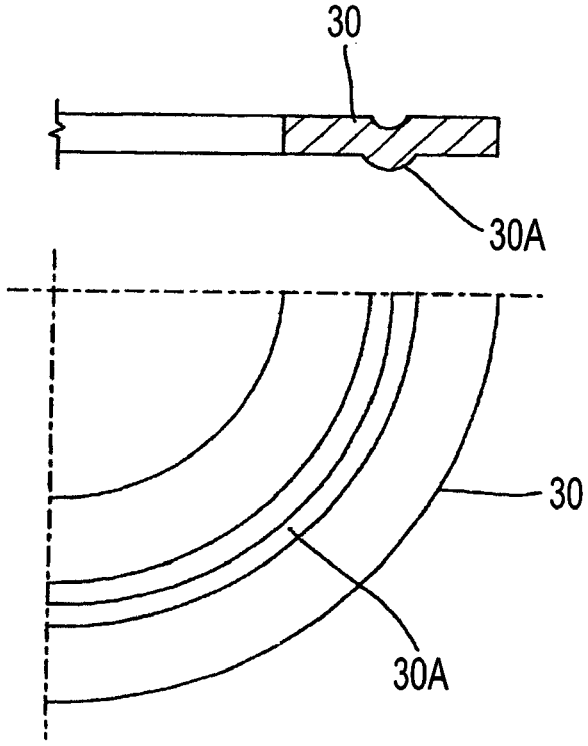
FIG. 18 Diagrams showing a magnet ring of the magnetron shown in FIG. 16.

The magnet ring 30 is configured in a manner that the outer diameter thereof is equal to or smaller than the outer diameter of the annular magnets 13A, 13B and is equal to or larger than the outer diameter of the anode cylinder 11. As shown in FIG. 18, a projection portion 20A is formed at a position contacting with the outer side surface of the anode cylinder 11, on a surface (hereinafter called a rear surface) of the magnet ring opposing to the anode cylinder 11. FIG. 18 is a sectional diagram which shows a part of the magnet ring 30 and also shows the lower surface side of this part. As shown in this figure, the projection portion 30A is formed in a rail shape so as to continue along the circumferential direction of the magnet ring 30.

Since the projection portion 30A is provided on the inner circumferential side than the outer circumferential end of the magnet ring on the rear surface of the magnet ring 30, most of the magnetic flux generated by the annular magnets 13A, 13B tends to be directed to the inner circumferential side. That is, more magnetic flux flows to the active space 18 at the periphery of the cathode structure 19, whereby the efficiency of a magnetic circuit can be improved.

Further, since the projection portion 30A is formed at the position contacting with the outer side surface of the anode cylinder 11, both the anode cylinder 11 and the magnet ring 30 can be positioned. Thus, the distribution of the magnetic field of the active space 18 can be stabilized, so that the stabilization and the improvement of efficiency of the oscillation can be achieved.

Figure 19:
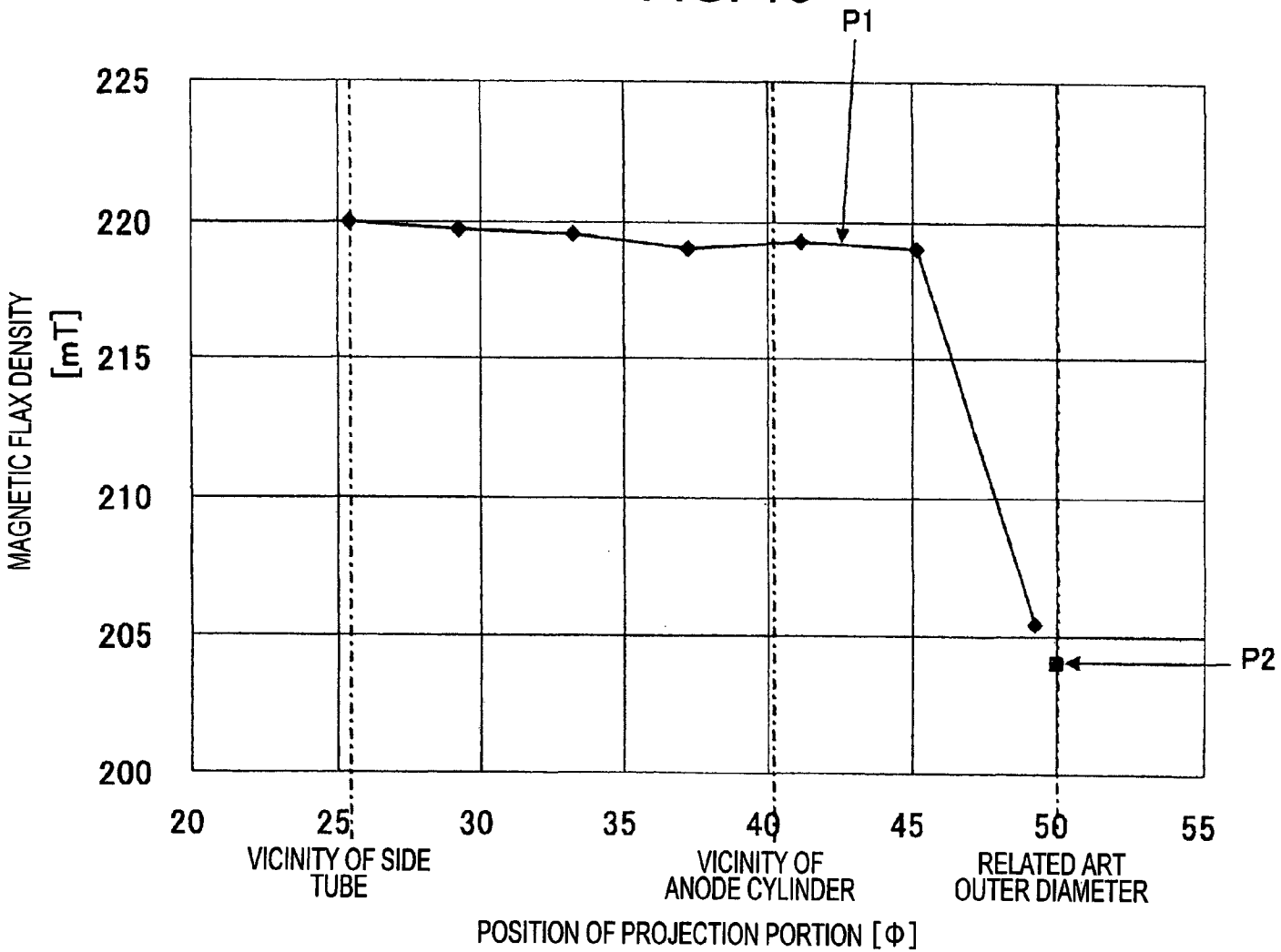
FIG. 19 A graph showing the magnetic flux density in the outer diameter direction of the magnet ring of the magnetron shown in FIG. 16.

FIG. 19 is a graph showing the relation between the radial direction position of the projection portion 30A and the magnetic flux density, wherein the abscissa represents the radial direction position (Φ) of the projection portion 30A and the ordinate represents the magnetic flux density (mT). P1 is a graph formed by plotting the values of the magnetic flux density in the case where the projection portion 30A is moved radially from a position near a side tube 14 on the anode side to the position of the outer diameter (outer circumferential end) of the magnet ring 30. P2 represents a plotted value of the magnetic flux density of the magnet ring 200 having the uniform thickness of the related art. The magnetic flux density at the position 50 mm of the outer diameter of the magnet ring 30 is about 204 mT. In contrast, the magnetic flux density becomes about 220 mT in the case where the projection portion 30A is provided in a range from 25 mm to 45 mm in the vicinity of the anode cylinder 11. That is, the magnetic flux density increases about 7% by providing the projection portion 30A within this range.

Since the magnetic flux density in a range equal to or lager than 45 mm but small than the position of the outer diameter (55 mm) of the magnet ring 30 is also larger than the magnetic flux density at the outer diameter of the magnet ring 30, the projection portion 30A may be provided at any position on the inner circumferential side than the outer circumferential end of the magnet ring 30. However, the position is preferably in a range equal to or smaller than 45 mm in a view point of increasing the magnetic flux density. In particular, the projection portion 30A is desirably provided at the position contacting with the outer side surface of the anode cylinder 11 in the vicinity of the anode cylinder 11. Instead, the projection portion 30A can be provided at the position contacting with the outer periphery of the pole piece 12. Thus, the positioning of the magnet ring 30 is made possible, whereby the positional deviation in the radial direction of the magnet ring 30 and the annular magnet 13A (13B) can be prevented. Accordingly, as described above, the distribution of the magnetic field of the active space 18 can be stabilized and so the stabilization and the improvement of efficiency of the oscillation can be achieved.

Figure 20:
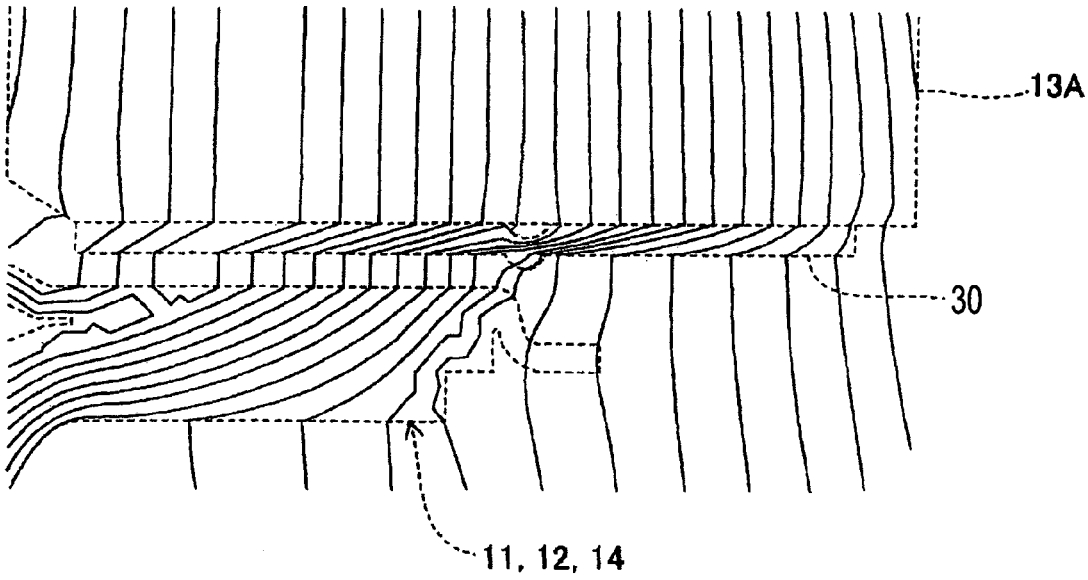
FIG. 20 A diagram showing the magnetic field distribution of the magnetron using the magnet ring shown in FIG. 18.
Figure 21:
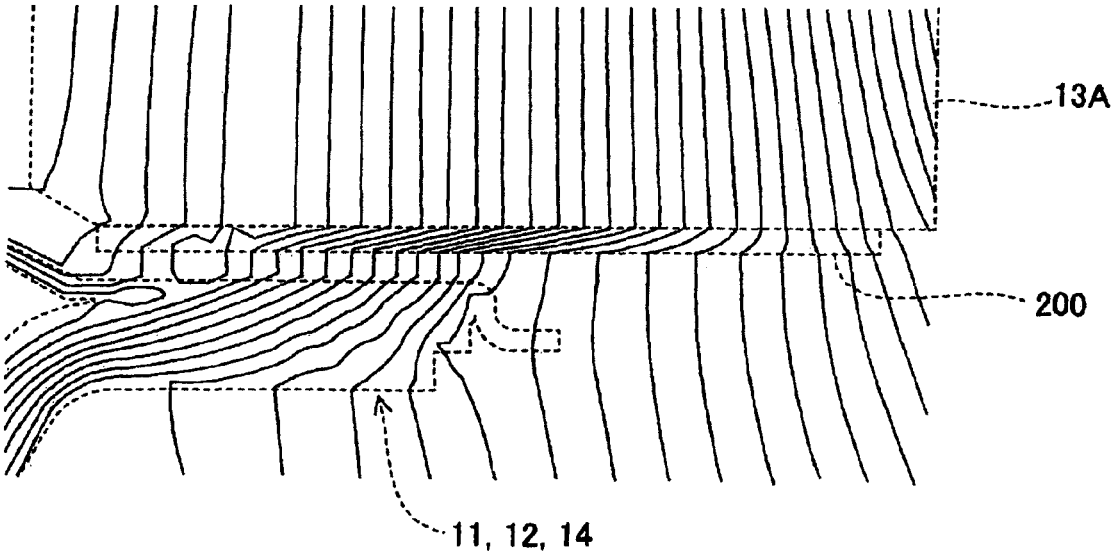
FIG. 21 A diagram showing the magnetic field distribution of the magnetron using the magnet ring of the related art.

FIG. 20 is a diagram showing the magnetic field distribution of the magnet ring 30 where the projection portion 30A is provided at the position contacting with the outer side surface of the anode cylinder 11, whilst FIG. 21 is a diagram showing the magnetic field distribution of the magnet ring 200 having the uniform thickness of the related art.

In this manner, according to the magnetron 3 of the embodiment, the projection portion 30A is provided at the position contacting with the outer side surface of the anode cylinder 11 on the rear surface (that is, the surface opposing to the anode cylinder 11) of the magnet ring 30. Thus, unlike the related art, there is no fear that the cut and erected part or the projection portions provided at the outer circumferential end of the magnet ring obstructs the flow of the magnetic flux lines. As a result, since more magnetic flux can be flown in the active space 18 at the periphery of the cathode structure 19, the efficiency of the magnetic circuit can be improved. Further, since the anode cylinder 11 and the magnet ring 30 can be correctly positioned, the distribution of the magnetic field of the active space 18 can be stabilized and the stabilization and the improvement of efficiency of the oscillation can be achieved. That is, the magnet ring 30 according to the invention can simultaneously achieve the improvement of the efficiency of the magnetic circuit and the stabilization of the magnetic field distribution in the active space.

Figure 22:
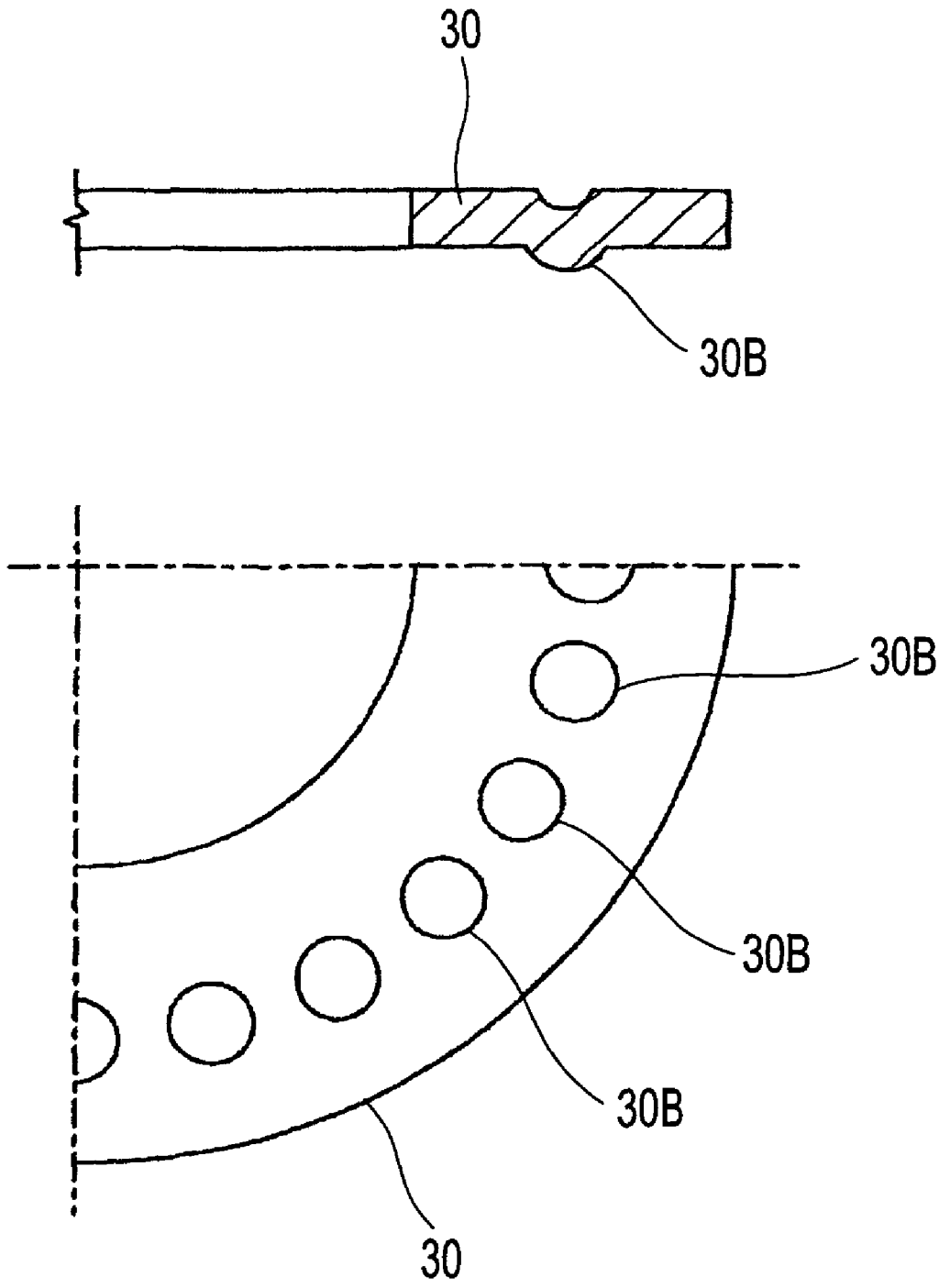
FIG. 22 A diagram showing an applied example of the magnet ring shown in FIG. 18.

In the aforesaid embodiment, although the projection portion 30A is formed in the rail shape so as to continue along the circumferential direction of the magnet ring 30 (concentric continuous rail), the shape of the projection portion is not limited thereto. For example, as shown in FIG. 22, a plurality of projection portions 30B each formed in a mountain shape may be disposed along the circumferential direction of the magnet ring 30. In this case, of course, the projection portions are also provided on the inner circumferential side than the outer circumferential end of the magnet ring on the rear surface of the magnet ring 30. Further, in order also to position the magnet ring 30, the projection portions provided on the inner circumferential side are preferably disposed at the position contacting with the outer side surface of the anode cylinder 11. Further, since a plurality of the projection portions 30B are provided along the circumferential direction of the magnet ring 30, the anode cylinder 11 and the magnet ring 30 can be positioned more firmly.

The mountain-shaped projection portion 30B has a size of the height of 0.2 mm and the diameter of 1 mm on the surface thereof contacting with the magnet, as an example.

The invention can achieve the improvement of the efficiency of the magnetic circuit and the stabilization of the magnetic field distribution in the active space, and can be applied to a device utilizing a microwave such as a microwave oven.

What is claimed is:

1. A magnetron comprising:

an anode cylinder having an inner wall on which a plurality of anode vanes are provided;

a pole piece provided on an end side of the anode cylinder;

a circular magnet provided on the vicinity of the pole piece; and a magnet ring provided between the anode cylinder and the circular magnet, wherein an outer diameter of the magnet ring is smaller than or equal to the outer diameter of the circular magnet and larger than or equal to the outer diameter of the pole piece, wherein:

an outer periphery of the magnet ring has a portion having a thickness which is different from a thickness of the magnet ring at an inner periphery of the magnet ring, and a first thickness of the magnetic ring between a first position corresponding to the outer diameter of the anode cylinder and the outer periphery as a second position are different from a second thickness of the remaining part of the magnet ring, wherein the first thickness of the magnet ring between the first position and the second position is smaller than the second thickness of the remaining part of the magnet ring.

2. The magnetron according to claim 1, wherein a thickness of the magnet ring between the first position and the second position is partially thin.

3. The magnetron according to claim 1, wherein the thickness of the magnet ring linearly changes from the first position to the second position.

4. The magnetron according to claim 1, wherein:

the magnet ring includes a plurality of bent parts directed to the anode cylinder and a plurality of plane parts at the outer periphery of the magnet ring, and the bent parts and the plane parts are periodically and alternately arranged.

5. A device utilizing a microwave comprising the magnetron according to claim 1.

6. The magnetron according to claim 1, wherein the thickness of the outer periphery of the magnet ring is smaller the thickness of the inner periphery of the magnet ring.

7. A magnetron comprising:

an anode cylinder having an inner wall on which a plurality of anode vanes are provided;

a pole piece provided on an end side of the anode cylinder;

a circular magnet provided on the vicinity of the pole piece; and a magnet ring provided between the anode cylinder and the circular magnet, wherein an outer diameter of the magnet ring is smaller than or equal to the outer diameter of the circular magnet and larger than or equal to the outer diameter of the pole piece, wherein the magnet ring has a projection portion directing to the anode cylinder between a first position corresponding to the outer diameter of the anode cylinder and the outer periphery as a second position, a first thickness of the magnetic ring between a first position corresponding to the outer diameter of the anode cylinder and the outer periphery as a second position are different from a second thickness of the remaining part of the magnet ring, and the first thickness of the magnet ring between the first position and the second position is smaller than the second thickness of the remaining part of the magnet ring.

8. The magnetron according to claim 7, wherein the projection portion is formed in a rail shape so as to continue along a circumferential direction of the magnet ring.

9. The magnetron according to claim 7, wherein at least one projection portion is formed in a convex shape.

10. The magnetron according to claim 9, wherein a plurality of the projection portions are disposed along the circumferential direction of the magnet ring.

11. The magnetron according to claim 7, wherein the projection portion is formed at a position contacting with an outer side surface of the anode cylinder.

12. The magnetron according to claim 7, wherein the projection portion is formed at a position contacting with an outer periphery of the pole piece.

13. A magnetron comprising:

an anode cylinder having an inner wall on which a plurality of anode vanes are provided;

a pole piece provided on an end side of the anode cylinder;

a circular magnet provided on the vicinity of the pole piece; and a magnet ring provided between the anode cylinder and the circular magnet, wherein an outer diameter of the magnet ring is smaller than or equal to the outer diameter of the circular magnet and larger than or equal to the outer diameter of the anode cylinder, wherein:

an outer periphery of the magnet ring has a portion having a thickness which is different from a thickness of the magnet ring at an inner periphery of the magnet ring, a first thickness of the magnetic ring between a first position corresponding to the outer diameter of the anode cylinder and the outer periphery as a second position are different from a second thickness of the remaining part of the magnet ring, and the first thickness of the magnet ring between the first position and the second position is smaller than the second thickness of the remaining part of the magnet ring.

14. A device utilizing a microwave comprising the magnetron according to claim 13.

15. The magnetron according to claim 13, wherein the thickness of the outer periphery of the magnet ring is smaller the thickness of the inner periphery of the magnet ring.

* * * * *